US005178270A

United States Patent [19]

Adams et al.

[11] Patent Number: 5,178,270

[45] Date of Patent: Jan. 12, 1993

[54] EASILY SEALABLE, OPENABLE, AND RECLOSABLE CARTON

[75] Inventors: John M. Adams, Mechanicsville; Christopher N. Chance, Richmond; James A. DeBlasio, Midlothian; Donald H. Evers, Richmond; William C. Harris, Jr., Midlothian; Michael A. Kirby, Sr., Trevilians; Reginald W. Newsome, Richmond; Robert E. Talley, Chester, all of Va.

[73] Assignee: Philip Morris Incorporated, New York, N.Y.

[21] Appl. No.: 892,766

[22] Filed: Jun. 3, 1992

Related U.S. Application Data

[63] Continuation-in-part of Ser. No. 831,348, Feb. 5, 1992, which is a continuation-in-part of Ser. No. 774,529, Oct. 8, 1991.

[51] Int. Cl.[5] ..... B65D 85/10; B65D 5/54

[52] U.S. Cl. ..... 206/256; 206/813; 206/273; 229/120.011

[58] Field of Search ..... 206/813, 273, 271, 256; 229/120.09, 120.011

[56] References Cited

U.S. PATENT DOCUMENTS

| | | | |
|---|---|---|---|
| 1,855,555 | 4/1932 | Miller . | |
| 2,109,583 | 3/1938 | Bennett | 206/813 |
| 2,390,412 | 12/1945 | Axberg | 229/51 |
| 2,565,509 | 8/1951 | Mancin | 206/813 |
| 2,605,897 | 8/1952 | Rundle | 206/264 |
| 2,672,276 | 3/1954 | Rudine | 229/120.08 |
| 2,697,544 | 12/1954 | Morand | 229/120.04 |
| 2,771,234 | 11/1956 | Hultin . | |
| 2,871,080 | 1/1959 | Shelly | 229/120.01 |
| 2,895,601 | 7/1959 | Krukonis | 206/256 |
| 2,973,130 | 2/1961 | Cottrill | 229/51 |
| 3,071,244 | 1/1963 | Doran | 206/273 |
| 3,082,929 | 3/1963 | Aquino et al. | 206/256 |
| 3,086,650 | 4/1963 | Chapman et al. | 206/273 |
| 3,092,301 | 6/1963 | Selle . | |
| 3,113,673 | 12/1963 | Stein . | |
| 3,135,457 | 6/1964 | Risucci | 229/120.011 |
| 3,144,190 | 8/1964 | Holt et al. . | |
| 3,158,312 | 11/1964 | Simkins . | |
| 3,163,351 | 12/1964 | Borgardt | 206/256 |
| 3,447,733 | 6/1969 | Smith et al. | 206/491 |
| 3,503,568 | 3/1970 | Galley . | |
| 3,536,246 | 10/1970 | Rosen | 206/256 |
| 3,596,758 | 8/1971 | Phillips, Jr. et al. | 206/256 |
| 3,721,335 | 3/1973 | Grant | 206/256 |
| 3,752,308 | 8/1973 | Begemann | 206/273 |
| 3,759,378 | 9/1973 | Werth | 206/429 |
| 3,809,227 | 5/1974 | Begemann | 206/264 |
| 4,205,776 | 6/1980 | Ruer | 229/120.01 |
| 4,424,658 | 1/1984 | Focke | 53/398 |
| 4,441,611 | 4/1984 | Sommariva | 206/431 |
| 4,485,926 | 12/1984 | Lenzmeier . | |
| 4,631,900 | 12/1986 | Mattei et al. | 53/448 |
| 4,669,611 | 6/1987 | Flaherty | 206/449 |
| 4,738,359 | 4/1988 | Phillilps, Jr. | 206/256 |
| 4,928,817 | 5/1990 | Focke | 206/264 |
| 4,932,534 | 6/1990 | Focke et al. . | |

FOREIGN PATENT DOCUMENTS 358560 10/1931 United Kingdom .

*Primary Examiner*—William I. Price

*Attorney, Agent, or Firm*—Jeffrey H. Ingerman; Karen G. Horowitz

[57] ABSTRACT

A cigarette carton formed from a blank in which the front and rear long walls of the carton are joined along a side wall instead of along a top or bottom wall. The carton thus has two sets of closure flaps, one set along the top end and another set along the bottom end. At least one set of closure flaps is a set of lap flaps, which are easily opened by a tax-stamping machine and easily closed by a machine. Preferably the other set of closure flaps is a tuck-in flap which is easily openable and reclosable by a consumer. Also disclosed is a multiple unit carton formed by applying adhesive bearing carrier means across top and bottom walls of the adjoining cartons. The multiple unit carton may be separated by a retailer or consumer for purchase of the individual component cartons.

80 Claims, 5 Drawing Sheets

EASILY SEALABLE, OPENABLE, AND RECLOSABLE CARTON

CROSS REFERENCE TO RELATED APPLICATIONS

This application is a continuation-in-part of copending, commonly-assigned U.S. patent application Ser. No. 07/831,348, filed Feb. 5, 1992, which is a continuation-in-part of copending, commonly-assigned U.S. patent application Ser. No. 07/774,529, filed Oct. 8, 1991, which applications are hereby incorporated by reference in their entirety.

BACKGROUND OF THE INVENTION

The present invention relates to a carton which is easily sealable, preferably by automated equipment, and easily openable by a consumer. More particularly, this invention relates to a carton having lap flaps on one end and preferably a tuck-in flap on the other end. Such a carton may be joined to a substantially identical carton to form a dual carton, and may be used for the packaging of cigarette packs. The present invention also relates to means for joining two cartons together to form a dual carton.

Cigarette packs (which usually contain twenty cigarettes) are generally rectangular in shape, having front and back long walls connected by two short side walls. Cigarette cartons typically contain two rows of five cigarette packs per row (each row arranged so that the front long walls of the packs are in the same plane and the back long walls are in a parallel plane spaced from the front long walls), and are generally known in the art as ten-pack cartons. Such cigarette cartons are generally filled with cigarette packs by the manufacturer, temporarily closed (e.g., by folding the top flap of the carton over the top of the carton and releasably securing the flap in the closed position), and shipped to various distributors. The distributors generally open the cartons to apply the tax stamp that may be required by the jurisdiction in which they operate to the ends of individual cigarette packs while the packs are still inside the cartons. Such procedures are commonly automated, to reduce time, cost, and labor, through the use of specially designed machines for applying tax stamps. Tax-stamping machines have been developed to open the cartons, apply the stamps, and finally seal the cartons for distribution. Such machines are generally commercially available, and are well known in the art. These machines have been developed for ten-pack cartons, i.e., cartons containing two rows of five cigarette packs per row. A typical tax-stamping machine is model FUSON manufactured by Meyercord of 365 East North Avenue, Carol Stream, Ill. 60187.

Cigarette cartons are typically formed from blanks in which the front and rear walls of the cartons are joined along their bottom edges by a bottom wall. Such cartons cannot be opened along their bottom wall because this bottom wall is an integral part of the blank from which the front and rear walls extend. Moreover, cigarette cartons typically have lapped flaps on their top ends, which are sealed with permanent adhesive, by such tax-stamping machines as described above, so that the cartons remain securely sealed in transit from the distributor to the retailer. Such flaps are desirable because they are easy to open by the plow of a tax-stamping machine when the flaps are joined with releasable adhesive, and easy to seal, after tax-stamping, by machine. However, such flaps are difficult for a consumer to open after tax-stamping because of the type of adhesive used, and generally are not reclosable.

If such cartons are provided with flaps which are to be tucked into the carton instead of lapped over each other over the carton, commercially available tax-stamping machinery is not typically equipped to close such cartons. Such tuck-in flaps, however, would be easier to open after tax-stamping, by a consumer, and would allow the consumer to reclose the carton.

SUMMARY OF THE INVENTION

It is therefore an object of this invention to provide a carton having flaps which are easily sealable, preferably by machine.

It is a further object of this invention to provide a carton having flaps which are easily opened by a consumer and which allow for reclosing of the carton.

It is another object of this invention to provide a carton which may be joined to a substantially identical carton to form a dual carton, whose flaps are easily sealed, preferably by machine.

These and other objects of the invention are accomplished in accordance with the principles of the invention by providing a blank for a carton in which the front and rear walls of the carton are joined along their side edges, i.e., the front and rear walls are integral with and extend from a side wall of the carton. The blank further includes a lap flap extending from the top edge of each of the front and rear walls, and preferably a tuck-in flap extending from the bottom edge of one of the front and rear walls. Such cartons may be dimensioned to contain one row of five cigarette packs per row, i.e., a five-pack carton, and joined to another such carton to form a dual carton having the dimensions of a ten-pack carton, common in the art. Such joining is desired so that the cartons may be passed through tax-stamping equipment which processes ten-pack cartons. The cartons should also be securely joined after tax-stamping for distribution to retailers and consumers. Such joining includes placing stickers across adjacent coplanar walls of the two cartons.

BRIEF DESCRIPTION OF THE DRAWINGS

Further features of the invention, its nature, and various advantages will be more apparent from the following detailed description of the preferred embodiments and the accompanying drawings wherein like reference characters represent like elements throughout, and in which.

FIG. i is a plan view of an illustrative carton blank in accordance with this invention having lap flaps on one end and a tuck-in flap on the other end.

DETAILED DESCRIPTION OF THE INVENTION

Figure 1:
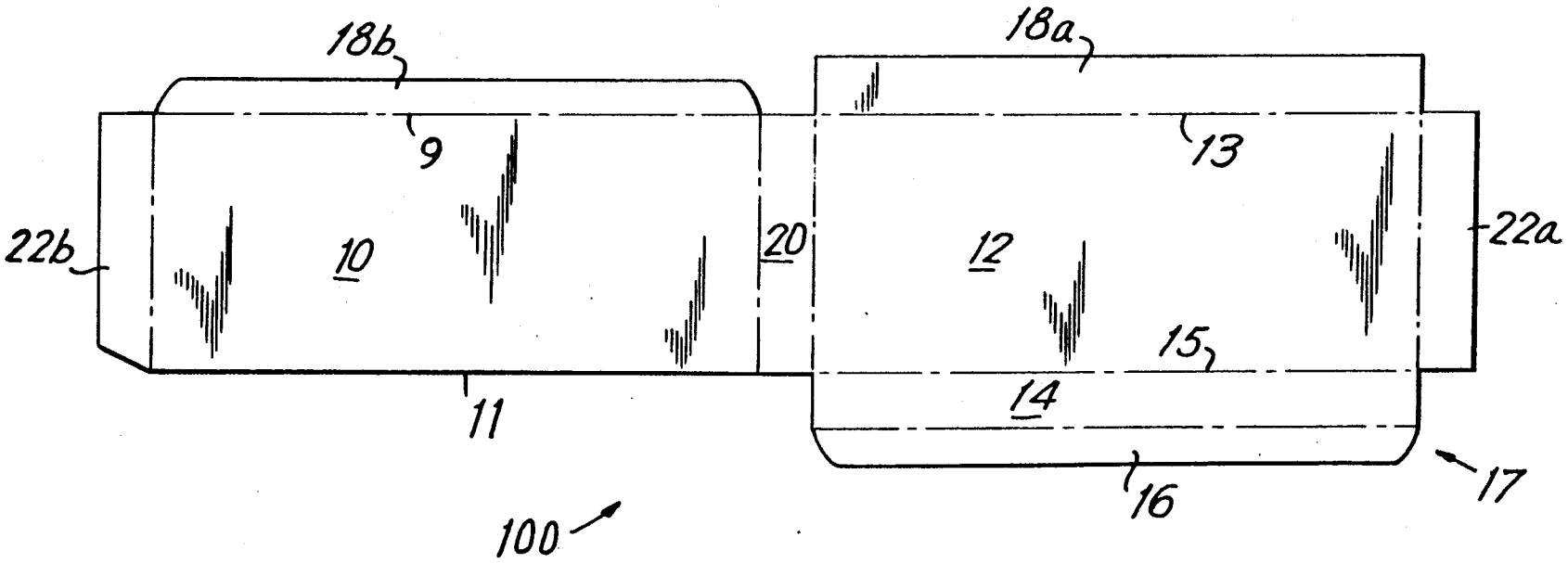

Blank 100, shown in FIG. 1, is formed from a substantially rigid material, such as cardboard or paperboard, and is folded along fold lines represented by unlabeled broken lines. Unlike a conventional blank for a cigarette carton, the front and rear long walls of the carton, i.e., the walls along which the long walls of cigarette packs contained in the carton are located, are positioned side by side and joined by a side wall instead of joined by the bottom wall of the carton. As used herein, a cigarette pack is defined as any pack commonly used for holding a predetermined number of cigarettes, and generally having front and back long walls connected by two short side walls. Thus, front wall 10 is joined to rear wall 12 by side wall 20, from which both walls 10 and 12 extend. Side closure panel 22*a* extends from the side edge of rear wall 12 distal from front wall 10. Side closure panel 22*b* extends from the side edge of front wall 10 distal from rear wall 12. Preferably the width of side panel 22*a* is substantially the same as the width of the formed carton, while the width of side panel 22*b* may be the same width as side panel 22*a* or narrower. Thus, when the blank is folded into a carton, side panel 22*a* is preferably folded over side panel 22*b* so that side wall 22, formed from panels 22*a* and 22*b*, appears to be a unitary side wall, and panel 22*b* lies adjacent the cigarette packs contained in the completed carton.

Blank 100 is also distinguished from a conventional cigarette carton in that the carton formed from blank 100 has a top lap flap closure and a bottom tuck-in flap closure. The top closure is composed of lap flaps 18*a* and 18*b*, extending from top edge 13 of wall 12 and top edge 9 of wall 10. The bottom closure is a tuck-in flap 17, formed from bottom closure panel 14 extending from bottom edge 15 of rear wall 12 and tuck-in panel 16 extending from panel 14. Preferably lap flap 18*a* extends the entire distance between walls 10 and 12 when blank 100 is folded into a carton, while lap flap 18*b* may be the same dimension as lap flap 18*a* or shorter. Lap flap 18*a* is preferably folded over lap flap 18*b* to form a laminated top wall to seal the carton formed from blank 100. The top closure is thus level and appears to be uniform. Bottom closure panel 14 extends the entire distance between walls 10 and 12 when blank 100 is folded into a carton. Tuck-in panel 16 may be any desired length which will remain tucked into the carton and is easy to remove from the tucked in position. When the formed carton is distributed to consumers, lap flaps 18*a* and 18*b* are preferably joined with permanent adhesive so that the carton does not accidentally open. Thus, it is not convenient for a consumer to open the carton by separating lap flaps 18*a* and 18*b*. The carton is more conveniently opened by untucking tuck-in flap 17 to access cigarette packs contained in the carton. Furthermore, while lap flap 18*a* and 18*b* cannot be rejoined to reclose the carton, tuck-in panel 17 may be tucked into the carton to close the carton and pulled out to open the carton as often as necessary. Although tuck-in panel 16 may optionally be provided with releasable adhesive to lightly secure tuck-in panel 16 to front wall 10 when tucked into the carton, such adhesive would only prevent accidental opening but would not greatly interfere with the ease in opening the tuck-in flap when pulled on by a consumer. Tuck-in panel 16 may optionally be secured to the exterior of front wall 10 with releasable adhesive and later be tucked into the carton by a consumer.

Figure 2:
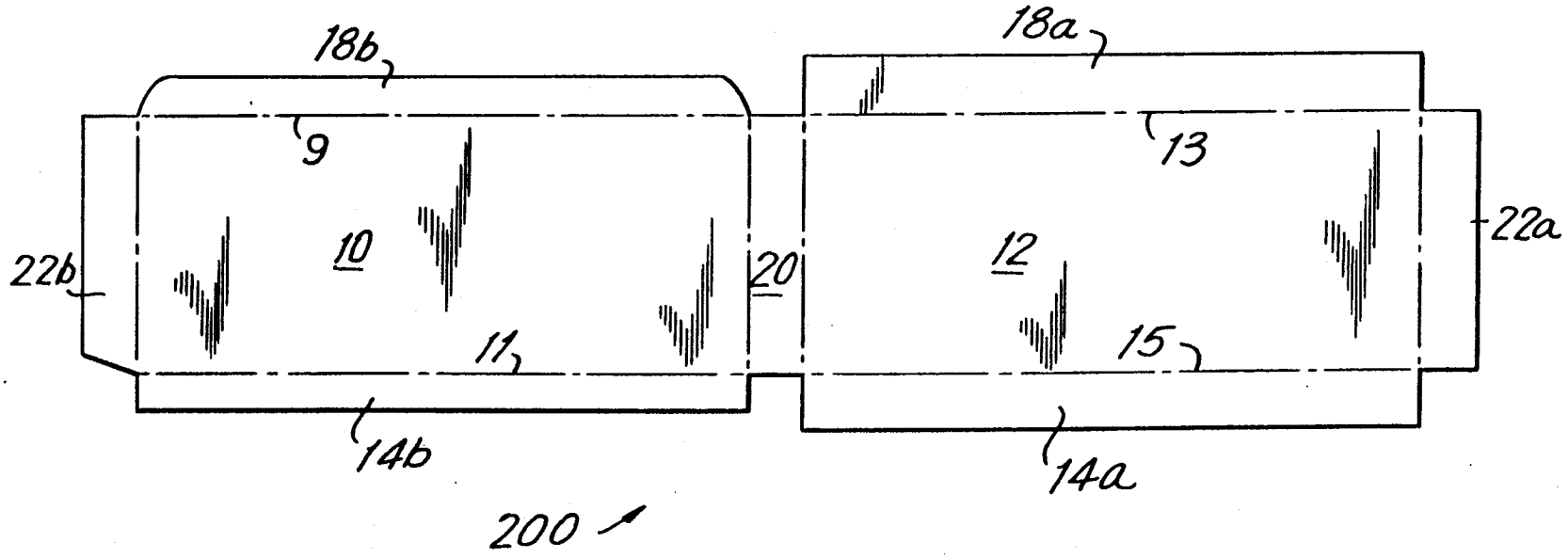
FIG. 2 is a plan view of an illustrative carton blank similar to the blank of FIG. 1 but with lap flaps on both ends.

Although a tuck-in flap is preferred, lap flaps 14*a* and 14*b*, such as shown extending from bottom edge 15 of wall 12 and bottom edge 11 of wall 10, respectively, of blank 200 in FIG. 2 may also be used. Such lap flaps are typically easier to seal by mechanized means, and would require fewer sealing steps than a tuck-in flap. The lap flaps may be joined by adhesive which remains tacky after the flaps are separated to facilitate reclosing of the carton.

Alternatively, tuck-in flaps may be used at both ends of the blank. The resulting blank (not shown) would have side by side front and rear walls and a tuck-in flap extending from each end of the blank, from either the front or rear wall.

Each front wall 10 and rear wall 12 may be sufficiently wider than five times the width of the long wall of a cigarette pack, so that a carton formed from blank 100 or blank 200 can contain five columns of cigarette packs. Typically, side walls 20 and 22 are sufficiently wider than two times the width of the short wall of a cigarette pack, so that a carton formed from blank 100 or blank 200 can contain two rows of cigarette packs. Alternatively, side walls 20 and 22 may be sufficiently wider than the width of the short wall of a cigarette pack, so that a carton formed from blank 100 or blank 200 can contain one row of cigarette packs. Such five-pack cartons formed from a blank such as blank 100 or blank 200 are shown in FIGS. 3–8, joined to a similar five-pack carton to form a dual carton dimensioned to hold two rows of five cigarette packs per row, i.e., having the dimensions of a conventional ten-pack cigarette carton.

Figure 3:
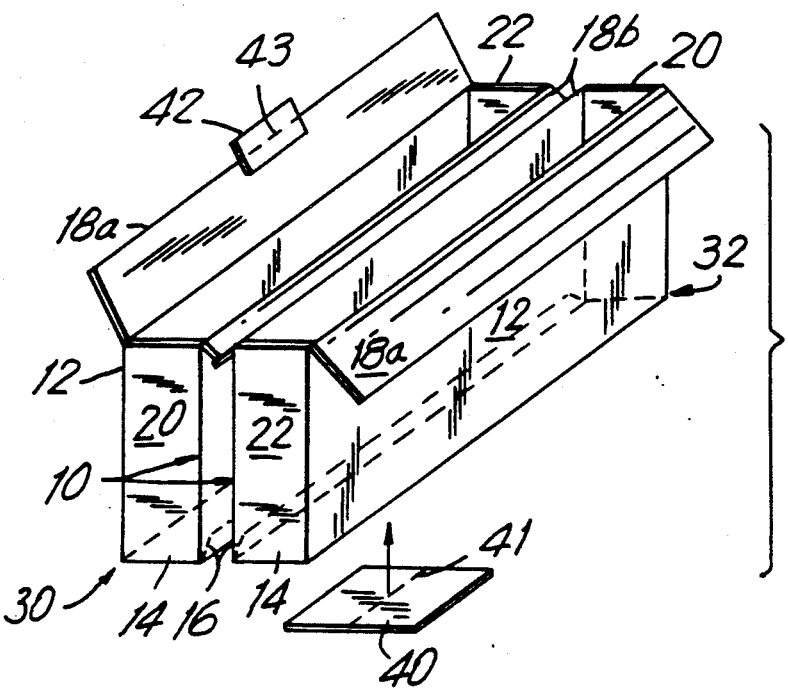
FIG. 3 is an isometric view showing the connection of two five-pack cartons formed from blanks such as shown in FIG. 1 to form a dual carton.
Figure 4:
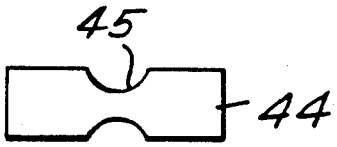
FIG. 4 is a plan view of an illustrative temporary closing means.

Completed cartons 30 and 32, each formed from blank 100, are shown in FIG. 3 positioned next to one another for joining to form a dual carton which may be passed through a tax-stamping machine through which ten-pack cigarette cartons are passed. Lap flaps 18*b* of each of cartons 30 and 32 are positioned between walls 10 so that the ends of the cigarette packs to be contained in cartons 30 and 32 are not obstructed by flaps 18*b* and may be tax-stamped. Also, such positioning is preferable because tax-stamping machines are typically designed to open a single pair of lap flaps, not two pairs of side by side lap flaps. Walls 10 are positioned adjacent one another with their boundaries coextensive. Because panel 22*a* is folded over panel 22*b*, and longer lap flaps 18*a* are positioned spaced from one another at the exterior of the dual carton, the free edge of panel 22*a* faces inwardly, between the two cartons. In this configuration, the free edge of panel 22*a* is relatively safe from being accidentally lifted from its place adjacent panel 22*b*.

A carrier means bearing adhesive, such as described in aforementioned U.S. patent application Ser. No. 07/774,529, is positioned across the bottom walls of the cartons. For example, label 40, preferably having a line of weakness such as perforated line 41, is positioned across bottom closure panels 14 to join the cartons. Perforated line 41 is preferably positioned along the adjoining edges of bottom closure panels 14 to facilitate later separation of the cartons, if desired, along line 41. If cartons 30 and 32 are formed from blanks such as blank 200, such a label as 40 may be applied across outer lap flaps 14*a* to thereby join the cartons. Label 40 may bear pricing indicia, such as U.P.C. (Universal Product Code) indicia, such as described in copending, commonly assigned U.S. patent application Ser. No. 07/792,617, filed Nov. 15, 1991, which is hereby incorporated by reference in its entirety. Such indicia are preferably coded for the pricing of the dual carton and are rendered unreadable upon separation of the individual cartons. Preferably, pricing indicia for the individual cartons are included on each carton. The indicia for sale of the five pack carton are positioned so that the indicia are accessible by automatic scanning equipment only after the cartons are separated.

Temporary closing means 42 is used to join longer lap flaps 18*a* to each other after they have been folded over the tops of their respective cartons to close the cartons. Closing means 42 preferably includes a line of weakness such as perforated line 43. Line 43 is preferably positioned along the adjoining edges of lap flaps 18*a* to facilitate later opening of the cartons along line 43 to access the ends of cigarette packs contained in cartons 30 and 32 to apply the required tax stamp. Closing means 42 may be formed of either paper or mylar or any similar material known in the art. Additionally or alternatively, temporary closing means 44, shown in FIG. 4, may be used. Closing means 44 includes a narrow central portion 45 which is preferably positioned adjacent the adjoining edges of lap flaps 18*a*. Although central portion 45 is shown having radiused edges, trapezoidal, triangular notched or rectangular edges may also be used. Portion 45 is wide enough to securely hold flaps 18*a* down in the closed position, yet narrow enough to sufficiently reduce the material which must be torn and thus facilitate later opening of the cartons. Closing means 44 is preferably formed of paper or similar material which allows for a clean tear. The exact dimensions of closing means 44 are preferably determined by the strength of the material used to form closing means 44 and the desired shape of narrow central portion 45. Preferably, only one side of closing means 42 or 44 bears adhesive. The adhesive bearing side of closing means 42 and 44 may either face cartons 30 and 32 or face away from cartons 30 and 32. If the adhesive bearing side faces the cartons, closing means 42 or 44 is adhered to the tops of flaps 18*a*. If the adhesive bearing side faces away from the cartons, closing means 42 or 44 is adhered to the underside of flaps 18*a*. Any desired number of temporary closing means 42 or 44, in combination or exclusively, may be used. Additional carrier means bearing adhesive similar to label 40 may be positioned across adjacent coplanar side walls 20 and 22 of cartons 30 and 32 to more securely join the two cartons. Preferably only one such label 40 bears pricing indicia.

Figure 5:
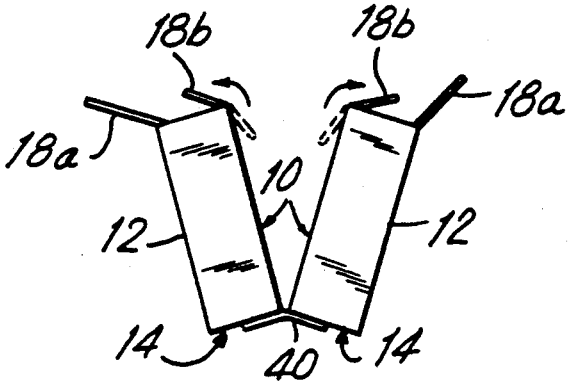
FIG. 5 is a side view of a step taken in sealing each carton of the dual carton configuration of FIG. 3.

After tax-stamping, each carton 30 and 32 must be sealed for distribution to retailers/consumers. The initial step in sealing cartons 30 and 32 is shown in FIG. 5. The cartons are pivoted along label 40, which joins the cartons along their bottom walls, so that flaps 18*b* may be removed from between walls 10, and folded over the tops of the cartons. Flaps 18*a* are preferably folded out of the way so that flaps 18*b* may be folded to be adjacent the cigarette packs contained in the cartons.

Figure 6:
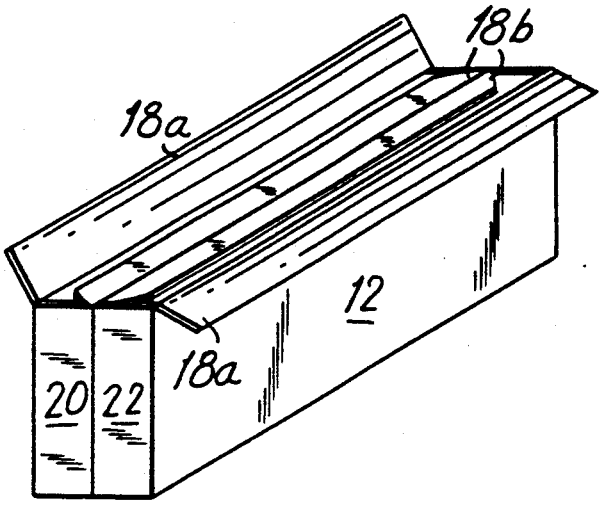
FIG. 6 is an isometric view of another step taken in sealing each carton of the dual carton configuration of FIG. 3.
Figure 7:
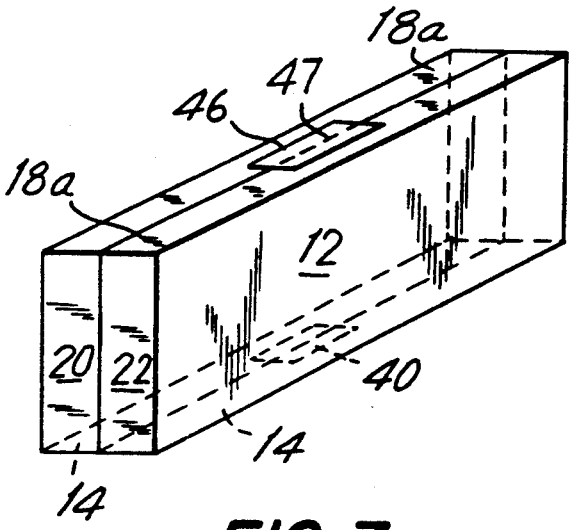
FIG. 7 is an isometric view of two sealed five-pack cartons joined to form a dual carton, each carton formed from a blank such as shown in FIG. 1 or FIG. 2.

After lap flaps 18*b* are folded over the tops of their respective cartons, as shown in FIG. 6, lap flaps 18*a* may be secured to the tops of lap flaps 18*b* to thereby close each of cartons 30 and 32. Preferably an adhesive which securely joins the flaps during transport and later distribution to retailers/consumers is used to join flaps 18*a* to 18*b*. The sealed carton may be further joined across flaps 18*a*, which are joined to their respective flaps 18*b*, with label 46. Label 46 may resemble label 40, preferably having a line of weakness such as perforated line 47 and formed of a mylar or paper (or any similar material) carrier means bearing adhesive on preferably only one side. Label 46 may, alternatively, resemble closing means 44, having a similar narrow central portion to facilitate later separation of the cartons. The central portion of such a "butterfly" label should be sufficiently narrow to facilitate tearing to separate the cartons, yet strong enough to hold the cartons together before separation. The carrier means of such a label preferably is formed of a material which allows for a relatively easy clean tear. Label 46, in either embodiment, may be placed over flaps 18*a* with the adhesive bearing side facing cartons 30 and 32, as shown in FIG. 7. Alternatively, label 46 may be placed on the undersides of flaps 18*a*, with the adhesive bearing side facing away from cartons 30 and 32. In this position, label 46 is not visible to consumers, yet sufficiently joins cartons 30 and 32 so that they may be sold in the dual carton configuration. The individual cartons remain sealed with adhesive joining flaps 18*a* and 18*b*. Any desired number of labels 46 may be used. A label 46 placed on the exterior of the carton may include pricing indicia. If so, label 46 preferably would be the only label bearing such indicia, and preferably resemble label 40 but not closing means 44.

Figure 8:
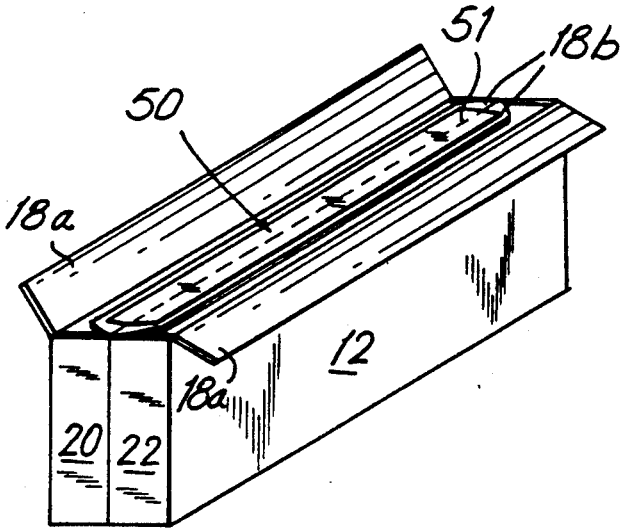
FIG. 8 is an isometric view of an additional step which may be taken to seal each carton of the dual carton configuration of FIG. 3.
Figure 9:
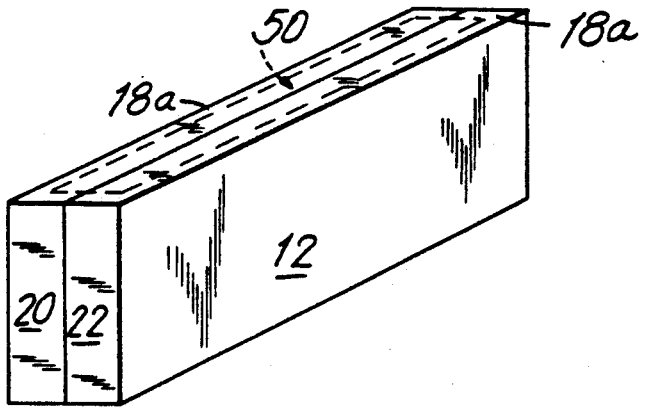
FIG. 9 is an isometric view of two five-pack cartons joined to form a dual carton, each carton formed from a blank such as shown in FIG. 1 or FIG. 2, an sealed with the additional step shown in FIG. 8.

Alternatively, as shown in FIG. 8, a joining strip 50, such as described in aforementioned U.S. patent application Ser. No. 07/831,348, may be applied across the tops of lap flaps 18*b* after flaps 18*b* have been folded over their respective cartons. Joining strip 50 preferably includes a line of weakness such as perforated line 51, positioned substantially above the plane of abutment of cartons 30 and 32 to facilitate later separation of cartons 30 and 32 along line 51, if desired. Either a single joining strip or a plurality of joining strips similar to strip 50 of FIG. 8 may be used. Alternatively, strips resembling the closing means of FIG. 4 may be used, with the narrow portion 45 adjacent the plane of abutment of cartons 30 and 32. Flaps 18*a* may then be secured to joining strip 50 (or strips resembling the closing means of FIG. 4) so that the means for joining cartons 30 and 32 is not readily visible. The joined and sealed cartons are shown in FIG. 9. Joining strip 50 is representatively shown in phantom, but is not readily visible.

In the preferred embodiment, consumers do not have to open cartons 30 and 32 by opening lap flaps 18*a* and 18*b*, but may open tuck-in flap 17, instead. Thus, cartons 30 and 32 are relatively easy to open to access cigarette packs contained inside.

Although cartons 30, 32 are described as each dimensioned to hold one row of five cigarette packs, they may be lengthened or shortened to hold more or fewer than five packs. Furthermore, two or more cartons may be joined together as disclosed, to form a multiple unit carton.

It will be appreciated that the use of adhesive to join lap flaps 18*a* and 18*b* may be used for joining any five-pack cartons having lap flaps without using a joining strip 50, including those five-pack cartons of aforementioned U.S. Pat. application Ser. No. 07/831,348. Furthermore, a label may or may not also be applied over the exterior lap flaps to further join the cartons.

It will further be appreciated that five-pack cartons formed from any blank design may be joined in the manners disclosed herein. Thus, temporary closing means such as closing means 42 and 44 may be used to close cartons formed from any blank design. Likewise, joining strip 50 or adhesive and an additional label 46 may be used to seal and join cartons formed from any blank design for wholesale or retail sale.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be appreciated that the directional references "top", "bottom", "front", and "rear" do not limit the respective panels to such orientation, but merely serve to distinguish these panels from one another.

It will be understood that the foregoing is merely illustrative of the principles of the invention, and that various modification can be made by those skilled in the art without departing from the scope and spirit of the invention. The described embodiments are presented for the purpose of illustration rather than limitation, and the present invention is limited only by the claims which follow.

What is claimed is:

1. A cigarette carton having a first end, and a second end, and dimensioned to contain a first number of cigarette packs, each said cigarette pack having a pair of opposed long walls joined by a pair of opposed short walls, said carton comprising:

a first pair of first and second opposed walls; and a first side wall; wherein:

each said first and second opposed walls has a first edge adjacent said first end, and a second edge adjacent said second end, each said first and second edges being at least as long as a second number of times the width of the long wall of a cigarette pack to be contained in said carton;

each said first and second opposed walls has a pair of first and second side edges joining said first and second edges;

said first wall is positioned substantially parallel to said second wall so that said first side edge of said first wall is juxtaposed to said second side edge of said second wall, and said second side edge of said first wall is juxtaposed to said first side edge of said second wall;

said first and second walls and said first side wall are formed from a unitary portion of a blank which forms said carton such that each said first and second walls extends from said first side wall, and said second side edge of said first wall and said first side edge of said second wall adjoin said first side wall and form edges of said first side wall;

said side wall is at least as wide as a third number of time the width of the short wall of a cigarette pack; and the product of said second number of times the width of the long wall of a cigarette pack and said third number of times the width of the short wall of a cigarette pack is equal to said first number of cigarette packs which are to be contained in said carton; said cigarette carton further comprising:

a first interior extension panel extending from said first edge of said first wall and having a distal edge;

a second exterior extension panel extending from said first edge of said second wall and having a distal edge; and a third extension panel extending from said second edge of one of said first and second opposed walls and having a distal edge.

2. The cigarette carton of claim 1 further including a fourth extension panel extending from said distal edge of said third extension panel, wherein said third extension panel is folded substantially perpendicular to said one of said first and second opposed walls and toward the other of said first and second opposed walls, and said fourth extension panel is folded substantially parallel to and adjacent the other of said first and second opposed walls to close said second end of said carton.

3. The cigarette carton of claim 2 wherein said first interior extension panel is folded substantially perpendicular to said first wall and toward said second wall, and said second exterior extension panel is folded substantially perpendicular to said second wall and secured over and to said first interior extension panel to close said first end of said carton.

4. The cigarette carton of claim 3 wherein said distal edge of said second extension panel lies adjacent said first edge of said first wall when said second extension panel is folded substantially perpendicular to said second wall and toward said first wall.

5. The cigarette carton of claim 3 wherein:

said first and second extension panels are secured with releasable adhesive to temporarily close said first end of said carton before passing said carton through a tax-stamping machine; and said first and second extension panels are secured with permanent adhesive to securely close said first end of said carton after passing said carton through a tax-stamping machine.

6. The cigarette carton of claim 1 wherein:

said distal edge of said second exterior extension panel lies adjacent said first edge of said first wall when said second exterior extension panel is folded substantially perpendicular to said second wall and toward said first wall; and said first interior extension panel is folded substantially perpendicular to said first wall and toward said second wall and said second exterior extension panel is folded substantially perpendicular to said second wall and secured over and to said first interior extension panel to close said first end of said carton.

7. The cigarette carton of claim 6 further including a fourth extension panel extending from said second edge of the other of said first and second opposed walls and having a distal edge; wherein:

the dimension of at least one of said third and fourth extension panels is substantially the same as the dimension of said second exterior extension panel; and the other of said third and fourth extension panels is folded substantially perpendicular to said first pair of opposed walls and toward said at least one of said third and fourth extension panels, and said at least one of said third and fourth extension panels is folded substantially perpendicular to said first pair of opposed walls and secured over and to said other of said third and fourth extension panels to close said second end of said carton.

8. The cigarette carton of claim 6 wherein said distal edge of said first interior extension panel lies between said first and second walls when said first interior extension panel is folded substantially perpendicular to said first wall and toward said second wall.

9. The cigarette carton of claim 1 further including a first side panel extending from one of said first side edge of said first wall and said second side edge of said second wall and extending toward the other of said first side edge of said first wall and said second side edge of said second wall to form a second side wall substantially parallel to said first side wall.

10. The cigarette carton of claim 9 further including a second side panel extending from the other of said first side edge of said first wall and said second side edge of said second wall and extending toward said one of said first side edge of said first wall and said second side edge of said second wall and overlapping said first side panel to form a second side wall.

11. The cigarette carton of claim 10 wherein at least one of said first and second side panels has a first pair of first and second edges which align with said first and second edges of said first and second walls, and a second pair of first and second side edges which abut said first side edge of said first wall and said second side edge of said second wall, respectively.

12. The cigarette carton of claim 11 wherein said at least one of said first and second side panels is positioned adjacent the exterior of said carton over the other of said first and second side panels.

13. The cigarette carton of claim 1 wherein said second number of times the width of the long wall of a cigarette pack is five.

14. The cigarette carton of claim 1 wherein said third number of times the width of the short wall of a cigarette pack is two.

15. The cigarette carton of claim 1 wherein said third number of times the width of the short wall of a cigarette pack is one.

16. The cigarette carton of claim 1 further comprising:

a second cigarette carton unit having a third end and a fourth end, and dimensioned to contain a fourth number of cigarette packs, said second cigarette carton unit comprising:

a second pair of third and fourth opposed walls; and a second side wall; wherein:

each said third and fourth opposed walls has a third edge adjacent said third end, and a fourth edge adjacent said fourth end, each said third and fourth edges being at least as long as said second number of times the width of the long wall of said cigarette pack;

each said third and fourth opposed walls has a pair of third and fourth side edges joining said third and fourth edges;

said third wall is positioned substantially parallel to said fourth wall so that said third side edge of said third wall is juxtaposed to said fourth side edge of said fourth wall, and said fourth side edge of said third wall is juxtaposed to said third side edge of said fourth wall;

said third and fourth walls and said second side wall are formed from a unitary portion of a blank which forms said carton such that each said third and fourth walls extend from said second side wall, and said fourth side edge of said third wall and said third side edge of said fourth wall adjoin said second side wall and form edges of said second side wall;

said second side wall is at least as wide as a fifth number of times the width of the short wall of a cigarette pack; and the product of said second number of times the width of the long wall of said cigarette pack and said fifth number of times the width of the short wall of a cigarette pack is equal to said fourth number of cigarette packs which are to be contained in said second cigarette carton unit; said second cigarette carton unit further comprising:

a fourth interior extension panel extending from said third edge of said third wall and having a distal edge;

a fifth exterior extension panel extending from said third edge of said fourth wall and having a distal edge; and a sixth extension panel extending from said fourth edge of one of said third and fourth opposed walls and having a distal edge; wherein said second cigarette carton unit is positioned with one of said third and fourth walls of said second cigarette carton unit adjacent and coextensive with one of said first and second walls of said cigarette carton to form a dual carton; and said first end of said cigarette carton is adjacent said third end of said second cigarette carton unit; said cigarette carton further comprising:

means for joining said cigarette carton to said second cigarette carton unit to form said dual carton.

17. The cigarette carton of claim 16 wherein:

said first wall of said cigarette carton is positioned adjacent and coextensive with said third wall of said second cigarette carton unit;

said second exterior extension panel of said cigarette carton is substantially the same length as said third number of times the short wall of a cigarette pack;

said fifth exterior extension panel of said second cigarette carton unit is substantially the same length as said fifth number of times the width of a cigarette pack; and said second exterior extension panel and said fifth exterior extension panel form a substantially continuous top wall extending across said first end of said cigarette carton and said third end of said second cigarette carton unit when said second and fifth exterior extension panels are folded to close said dual carton.

18. The cigarette carton of claim 17 wherein said first and fourth interior extension panels are folded substantially parallel to and between said adjacent coextensive walls when said cartons are joined so that the ends of the cigarette packs contained in said cartons may be fully exposed when said second and fifth exterior extension panels of said cartons are folded away from said cartons.

19. The cigarette carton of claim 18 wherein said second and fifth exterior extension panels are folded substantially perpendicular to said second and fourth walls and toward said first and third walls to close said cigarette cartons.

20. The cigarette carton of claim 19 further including a joining means applied across said second and fifth exterior extension panels to secure said second and fifth exterior extension panels in said folded position.

21. The cigarette carton of claim 20 wherein said joining means includes a weakened area positioned substantially adjacent said distal edges of said second and fifth exterior extension panels.

22. The cigarette carton of claim 21 wherein said weakened area comprises a portion of said joining means narrower than the remainder of said joining means.

23. The cigarette carton of claim 21 wherein said weakened area comprises a line of weakness.

24. The cigarette carton of claim 23 wherein said line of weakness comprises a perforated line.

25. The cigarette carton of claim 17 wherein said first and fourth interior extension panels are folded substantially perpendicular to said first and third walls and toward said second and fourth walls to at least partially close said first end of said cigarette carton and said third end of said second cigarette carton unit.

26. The cigarette carton of claim 25 wherein said second and fifth exterior extension panels are folded substantially perpendicular to said second and fourth walls and toward said first and third walls, respectively, and are secured to said first and fourth interior extension panels, respectively, to close said first end of said cigarette carton and said third end of said second cigarette carton unit.

27. The cigarette carton of claim 26 wherein said second and fifth exterior extension panels are secured to said first and fourth interior extension panels, respectively, with adhesive.

28. The cigarette carton of claim 27 wherein said adhesive is permanent adhesive.

29. The cigarette carton of claim 27 further including a joining means applied across said second and fifth exterior extension panels to secure said cigarette cartons together in said dual carton configuration.

30. The cigarette carton of claim 29 wherein said joining means includes a weakened area positioned substantially parallel to said distal edges of said second and fifth exterior extension panels.

31. The cigarette carton of claim 30 wherein said weakened area comprises a portion of said joining means narrower than the remainder of said joining means.

32. The cigarette carton of claim 30 wherein said weakened area comprises a line of weakness.

33. The cigarette carton of claim 32 wherein said line of weakness comprises a perforated line.

34. The cigarette carton of claim 25 further including a joining strip applied across said first and fourth interior extension panels to join said cigarette cartons in said dual carton configuration.

35. The cigarette carton of claim 34 wherein said second and fifth exterior extension panels are folded substantially perpendicular to said second and fourth walls and toward said first and third walls, respectively, and secured to said joining strip to thereby close said first end of said cigarette carton and said third end of said second cigarette carton unit.

36. The cigarette carton of claim 16 wherein:

said third extension panel of said cigarette carton is folded substantially perpendicular to and toward the other of said first and second walls to thereby form a bottom wall to close said carton; and said sixth extension panel of said second cigarette carton unit is folded substantially perpendicular to and toward the other of said third and fourth walls to thereby form a bottom wall to close said carton unit.

37. The, cigarette carton of claim 36 further including a joining means applied across said third and sixth extension panels to secure said third and sixth extension panels in said folded position.

38. The cigarette carton of claim 37 wherein said joining means includes a weakened area positioned substantially adjacent said distal edges of said third and sixth extension panels.

39. The cigarette carton of claim 38 wherein said weakened area comprises a portion of said joining means narrower than the remainder of said joining means.

40. The cigarette carton of claim 39 wherein said weakened area comprises a line of weakness.

41. The cigarette carton of claim 40 wherein said line of weakness comprises a perforated line.

42. The cigarette carton of claim 16 wherein:

said first wall of said cigarette carton is positioned adjacent and coextensive with said third wall of said second cigarette carton unit; and said first and fourth interior extension panels are folded substantially parallel to and between said adjacent coextensive walls when said cartons are joined so that the ends of the cigarette packs contained in said cartons may be fully exposed when said second and fifth exterior extension panels of said cartons are folded away from said cartons.

43. The cigarette carton of claim 42 wherein said cartons are pivoted about said joining means positioned across said third and sixth extension panels to access said first and fourth interior extension panels.

44. A blank for forming a cigarette carton dimensioned to contain a first number of cigarette packs, each said cigarette pack having a first pair of opposed long walls and a second pair of opposed short walls, said blank comprising:

a first side panel having a pair of first and second edges and a pair of first and second side edges adjoining said first and second edges;

a first wall panel extending from and joined to said first side edge of said first side panel and having a pair of first and second edges, and a pair of first and second side edges adjoining said first and second edges a second wall panel extending from and joined to said second side edge of said first side panel and having a pair of first and second edges and a pair of first and second side edges joining said first and second edges;

a first extension panel extending from said first edge of said first wall panel and having a distal edge;

a second extension panel extending from said first edge of said second wall panel and having a distal edge; and a third extension panel extending from said second edge of one of said first and second wall panels and having a distal edge; wherein:

said blank is a unitary, one-piece blank;

the length of each of said first and second edges of said first and second wall panels is at least as long as a second number of times the width of the long wall of a cigarette pack;

the length of each of said first and second side edges of said first wall panel, said second wall panel, and said first side panel is at least as long as the height of a cigarette pack in a direction substantially parallel to the longitudinal axes of cigarettes in said cigarette pack;

the length of each of said first and second edges of said first side panel is at least as long as a third number of times the width of the short wall of a cigarette pack;

said first side edge of said first side panel and said second side edge of said first wall panel are coextensive;

said second side edge of said first side panel and said first side edge of said second wall panel are coextensive;

said first edges of said first wall panel, said first side panel, and said second wall panel are substantially collinear; and said second edges of said first wall panel, said first side panel, and said second wall panel are substantially collinear.

45. The blank of claim 44 wherein at least two panels are joined along a fold line to facilitate folding said blank into a carton.

46. The blank of claim 44 further including a second side panel extending from one of said first side edge of said first wall panel and said second side edge of said second wall panel, and having substantially the same dimensions as said first side panel.

47. The blank of claim 46 further including a third side panel extending from the other of said first side edge of said first wall panel and said second side edge of said second wall panel wherein when said blank is erected into a carton said second side panel is folded over said third side panel to form a laminated side wall of said carton, said laminated side wall substantially parallel to and the same dimension as said first side panel of said carton.

48. The blank of claim 47 wherein at least two panels are joined along a fold line to facilitate folding said blank into a carton.

49. The blank of claim 44 wherein:

said third extension panel has a pair of first and second edges and a pair of first and second side edges joining said first and second edges;

said first edge of said third extension panel is adjacent and coextensive with said second edge of said one of said first and second wall panels;

said second edge of said third extension panel is said distal edge and is substantially parallel to and the same length as said first edge of said third extension panel;

said first and second side edges of said third extension panel are substantially perpendicular to said first and second edges of said third extension panel; and the length of each of said first and second side edges of said third extension panel is substantially the same as the length of said first and second edges of said first side panel.

50. The blank of claim 49 further including a fourth extension panel extending from said distal edge of said third extension panel; wherein:

said third and fourth extension panels form a tuck-in flap of a carton formed from said blank;

said distal edge of said third extension panel lies adjacent said second edge of the other of said first and second wall panels when said blank is erected into a carton and said third extension panel is folded substantially perpendicular to said one of said first and second wall panels and toward said other of said first and second wall panels; and said fourth extension panel lies substantially parallel to said first and second wall panels when said blank is erected into a carton and said tuck-in flap is folded to close said second end of said carton.

51. The blank of claim 50 wherein at least two panels are joined along a fold line to facilitate folding said blank into a carton.

52. The blank of claim 49 further including a fourth extension panel extending from said second edge of the other of said first and second wall panels, wherein said third and fourth extension panels are overlapped to form a laminated panel for closing said second end of said carton.

53. The blank of claim 52 wherein said third extension panel is folded over said fourth extension panel to form said laminated panel.

54. The blank of claim 52 wherein at least two panels are joined along a fold line to facilitate folding said blank into a carton.

55. The blank of claim 44 wherein said blank is a paperboard blank.

56. The blank of claim 44 wherein said second number of times the width of the long wall of a cigarette pack is five.

57. The blank of claim 44 wherein said third number of times the width of the short wall of a cigarette pack is one.

58. The blank of claim 44 wherein said third number of times the width of the short wall of a cigarette pack is two.

59. A multiple unit cigarette carton for packaging a first number of cigarette packs and of dimensions compatible with commercially available tax-stamping machinery used in the automated processing of cigarette cartons, each said cigarette pack having a pair of opposed long walls and a pair of opposed short walls, said dual cigarette carton comprising:

first and second cartons each having a first end and a second end, a first pair of first and second opposed walls having a first edge adjacent said first end and a second edge adjacent said second end, a second pair of third and fourth opposed walls having a first edge adjacent said first end and a second edge adjacent said second end, a top wall joining at least said first edges of said first pair of opposed walls, and a bottom wall joining at least said second edges of said first pair of opposed walls; wherein:

said first pair of first and second walls are at least as wide as a second number of times the width of the long wall of a cigarette pack;

said second pair of third and fourth walls are at least as wide as a third number of times the width of the short wall of a cigarette pack; and said first and second cartons are positioned with said first wall of said first carton adjacent and coextensive with said first wall of said second carton; said dual cigarette carton further comprising:

a first substantially flat carrier means having a first side and a second side, and an adhesive borne on one side of said carrier means, said first carrier means being positioned across said bottom walls of said first and second cartons with said adhesive side in operative contact with said bottom walls to thereby join said first and second cartons to form said dual carton; and a second substantially flat carrier means having a first side and a second side, and an adhesive borne on one side of said carrier means, said second carrier means being positioned across said top walls of said first and second cartons with said adhesive side in operative contact with said top walls to thereby further join said first and second cartons to form said dual carton; wherein:

a fourth number of cigarette packs, equal to the product of said second number of times the width of the long wall of said cigarette pack and said third number of times the width of the short wall of said cigarette pack, can be positioned inside each of said first and second cartons with said short walls parallel to said side walls.

60. The multiple cigarette carton of claim 59 wherein:

said top wall of each of said first and second cartons is formed from a first extension panel extending from said first edge of one of said first and second walls and having a distal edge; and said first extension panel is folded substantially perpendicular to said first and second walls with said distal edge adjacent said first edge of the other of said first and second walls.

61. The multiple cigarette carton of claim 60 further including a second extension panel extending from said distal edge of said first extension panel of each of said first and second cartons and folded substantially perpendicular to said first extension panel and toward said bottom wall to thereby close said first and second cartons.

62. The multiple cigarette carton of claim 61 wherein said second extension panel of each of said first and second cartons is tucked into each of said first and second cartons, respectively.

63. The multiple cigarette carbon to claim 61 wherein said second extension panel of each of said first and second cartons is secured to the outside of said first and second cartons, respectively,

64. The multiple carton of claim 61 further including:

a third extension panel extending from said second edge of said first wall of each of said first and second cartons and having a distal edge; and a fourth extension panel extending from said second edge of said second wall of each of said first and second cartons and having a distal edge; wherein:

said third extension panel and said fourth extension panel of each of said first and second cartons are overlapped to form said bottom wall of said first and second cartons.

65. The multiple carton of claim 64 wherein:

said distal edge of at least one of said third and fourth extension panels of each of said first and second cartons lies adjacent said second edge of the wall opposite said wall from which said at least one of said third and fourth extension panels extends; and said at least one of said third and fourth extension panels is positioned to lie adjacent the exterior of said carton.

66. The multiple cigarette carton of claim 59 further comprising a second extension panel extending from said first edge of the other of said first and second walls of each of said first and second cartons wherein said first and second extension panels of each of said first and second cartons are overlapped with said first extension panel adjacent the exterior of said dual cigarette carton to form said top wall of each of said first and second cartons.

67. The multiple cigarette carton of claim 66 wherein said first extension panel of each of said first and second cartons is adhered to said second extension panel to close said first end of said first and second cartons.

68. The multiple cigarette carton of claim 66 further including:

a third extension panel extending from said second edge of said first wall of each of said first and second cartons and having a distal edge; and a fourth extension panel extending from said second edge of said second wall of each of said first and second cartons and having a distal edge; wherein:

said third extension panel and said fourth extension panel of each of said cartons are overlapped to form said bottom wall of said first and second cartons.

69. The multiple cigarette carton of claim 59 wherein at least one of said carrier means has a weakened area which can readily be severed to separate said first and second cartons.

70. The multiple cigarette carton of claim 69 wherein said at least one of said carrier means includes both said carrier means.

71. The multiple cigarette carton of claim 69 wherein said weakened area comprises a portion of said carrier means narrower than the remainder of said carrier means.

72. The multiple cigarette carton of claim 69 wherein said weakened area comprises a line of weakness.

73. The multiple cigarette carton of claim 72 wherein said line of weakness comprises a perforated line.

74. The multiple cigarette carton of claim 72 wherein said line of weakness is positioned along and substantially parallel to the plane of abutment of said first and second cigarette cartons.

75. The multiple cigarette carton of claim 59 wherein:

at least one of said top wall and said bottom wall of each of said first and second carton is formed from an extension panel extending from said first wall overlapping an extension panel extending from said second wall; and each said extension panel has an interior surface adjacent the interior of said first and second cartons and an exterior surface adjacent the exterior of said first and second cartons.

76. The multiple cigarette carton of claim 75 wherein at least one of said first and second carrier means is positioned with said adhesive bearing side in operative contact with the exterior surface of at least one extension panel of each of said first and second cartons.

77. The multiple cigarette carton of claim 76 wherein said extension panels are adhered to one another.

78. The multiple cigarette carton of claim 75 wherein at least one of said first and second carrier means is positioned between said overlapped extension panels.

79. The multiple cigarette carton of claim 78 wherein at least one of said first and second carrier means is positioned with said adhesive bearing side in operative contact with the interior surface of at least one extension panel of each of said first and second cartons.

80. The multiple cigarette carton of claim 79 wherein said overlapped extension panels are adhered to one another.

* * * * *